US005664786A

United States Patent [19]

Buschhaus et al.

[11] Patent Number: 5,664,786

[45] Date of Patent: Sep. 9, 1997

[54] APPARATUS AND METHOD FOR USE IN HANDLING SHEET MATERIAL ARTICLES

[75] Inventors: Michael C. Buschhaus, Springboro, Ohio; Richard B. Hawkes, Bethlehem, Pa.

[73] Assignee: Heidelberg Finishing Systems, Inc., Dayton, Ohio

[21] Appl. No.: 606,483

[22] Filed: Mar. 4, 1996

[51] Int. Cl.[6] ..... B65H 5/00; B65H 3/64; B65H 3/32

[52] U.S. Cl. ..... 271/10.09; 271/112; 271/113; 271/114; 271/99; 271/165

[58] Field of Search ..... 271/10.09, 10.11, 271/101, 113, 114, 115, 270, 112, 99, 104, 165

[56] References Cited

U.S. PATENT DOCUMENTS

| | | | |
|---|---|---|---|
| 678,754 | 7/1901 | McNutt | 271/113 |
| 2,799,497 | 7/1957 | Novick | 271/101 X |
| 3,650,525 | 3/1972 | Hageman et al. . | |
| 3,702,187 | 11/1972 | Hageman et al. . | |
| 3,913,478 | 10/1975 | Terzuolo et al. | 271/114 X |
| 3,960,079 | 6/1976 | Capetti | 271/270 X |
| 5,330,169 | 7/1994 | Hawkes . | |

*Primary Examiner*—Boris Milef

*Attorney, Agent, or Firm*—Tarolli, Sundheim, Covell, Tummino & Szabo

[57] ABSTRACT

A rotating separator disk is movable between sheet material articles in a stack of sheet material articles. A variable speed drive which is connected with the separator disk and rotates the separator disk. The variable speed drive is operable to vary the speed of rotation of the separator disk between a high speed and a low speed during each revolution of the separator disk. First and second restrictor members engage a sheet material article in the stack of sheet material articles. A suction applicator head is operable to disengage one sheet material article from the first restrictor member. A leading edge of the rotating separator disk is then moved between the one sheet material article and an adjacent sheet material article. As this occurs, the speed of rotation of the separator disk is increased and the one sheet material article is disengaged from the second restrictor member by the separator disk.

35 Claims, 3 Drawing Sheets

APPARATUS AND METHOD FOR USE IN HANDLING SHEET MATERIAL ARTICLES

BACKGROUND OF THE INVENTION

The present invention relates to an apparatus and method for use in handling sheet material articles and more specifically to an apparatus and method for feeding sheet material articles from a stack of sheet material articles.

Known devices for feeding sheet material articles from a stack of sheet material articles are disclosed in U.S. Pat. Nos. 3,650,525; 3,702,187 and 5,330,169. These devices include a suction applicator head which is movable to pull an edge portion of a lowermost sheet material article downward to form a gap between the lowermost sheet material article and the next adjacent sheet material article. A leading edge of a rotating separator disk is moved into the gap to further deflect the edge portion of the lowermost sheet material article so that it can be engaged by a feed drum. The feed drum pulls the sheet material article from the stack and deposits the sheet material article onto a collator conveyor.

There is a limited amount of time for the suction applicator head to pull the lowermost sheet material article downward to form a gap and for the rotating separator disk to move into the gap. In order to decrease the time required for the separator disk to move into the gap, the separator disk has previously been constructed with a relatively large outside diameter so that the periphery of the disk is moving at a high speed. Constructing the separator disk with a large outside diameter is frequently unacceptable due to space limitations. An alternative arrangement has been to rotate the separator disk so fast that it rotates through two complete revolutions each time a sheet material article is fed from the stack. This has the inherent drawback of allowing the lower sheet material article in the stack to droop downward in a manner which tends to promote misfeeding of sheet material articles and/or jamming of the leading edge portion of the separator disk against sheet material articles.

In the past, a single restrictor or support member has been used to support a corner portion of a stack of sheet material articles adjacent to the operator side of the stack. The lowermost sheet material article in the stack of sheet material articles is disengaged from the restrictor by the suction applicator head. A restrictor has not been provided at the opposite or feed corner portion of the stack of sheet material articles.

SUMMARY OF THE INVENTION

The present invention provides a new and improved method and apparatus for use in handling sheet material articles. The apparatus includes a separator assembly which separates one sheet material article in a stack of sheet material articles from a next adjacent sheet material article in the stack of sheet material articles. Thereafter, a feed assembly moves the one sheet material article from the stack of sheet material articles.

The separator assembly includes a rotatable separator disk. A variable speed drive is connected with the separator disk and varies the speed of rotation of the separator disk between a high speed and a low speed during each revolution of the separator disk relative to the stack of sheet material articles.

When one sheet material article is to be fed from the stack of sheet material articles, a gap may be formed between a portion of the one sheet material article and the next adjacent sheet material article. A leading edge of the rotating separator disk is moved from a location offset to one side of the stack of sheet material articles to a location between the one sheet material article and the next adjacent sheet material article. As this occurs, the speed of rotation of the separator disk is increased.

The stack of sheet material articles may advantageously be engaged by first and second restrictor members disposed in engagement with opposite sides of the stack of sheet material articles. One sheet material article in the stack of sheet material articles is moved relative to the first restrictor member to form a gap into which the leading edge of the rotating separator disk moves. During continued rotation of the separator disk, the one sheet material article is disengaged from the second restrictor member under the influence of force applied against the one sheet material article by the separator disk.

BRIEF DESCRIPTION OF THE DRAWINGS

The foregoing and other objects and features of the present invention will become more apparent upon a consideration of the following description taken in connection with the accompanying drawings, wherein.

DESCRIPTION OF ONE SPECIFIC PREFERRED EMBODIMENT OF THE INVENTION

General Description

Figure 1:
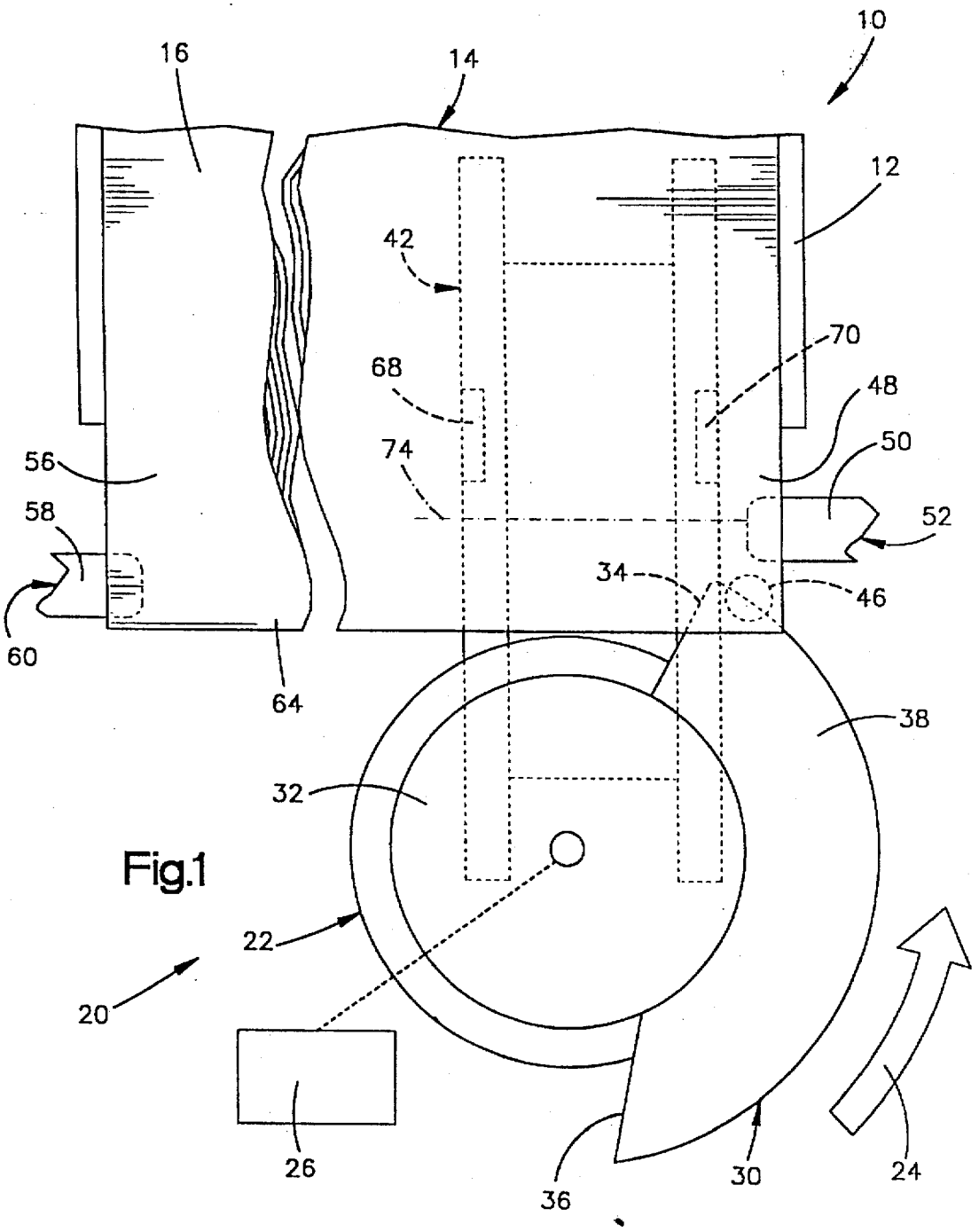
FIG. 1 is a schematic top plan view of an apparatus constructed and operated in accordance with the present invention and illustrating the manner in which a leading edge portion of a separator disk moves into a gap between a lowermost sheet material article in a stack of sheet material articles and a next adjacent sheet material article.

An apparatus 10 (FIG. 1) for use in handling sheet material articles is constructed and operated in accordance with the present invention. The apparatus 10 includes a rectangular hopper 12 which holds a stack 14 of rectangular sheet material articles 16. The sheet material articles 16 may be signatures, newspaper sections, individual sheets of material, or other sheet material items.

An improved separator assembly 20 is constructed and operated in accordance with the present invention to separate a lowermost sheet material article 16 in the stack 14 of sheet material articles from a next adjacent sheet material article. The separator assembly 20 includes a circular separator disk 22 which is rotated, in the direction of the arrow 24 in FIG. 1, about a vertical axis by a drive assembly 26. The separator disk 22 has a relatively large radius portion 30 which projects radially outward from a circular base portion 32. The large radius portion 30 has a leading edge portion 34 and a trailing edge portion 36.

The large radius portion 30 of the separator disk 22 has a flat upper side surface 38 which is slidable along a horizontal lower side surface of a sheet material article 16 which is next adjacent to a lowermost sheet material article in the stack 14 of sheet material articles. The upper side surface 38 on the large radius portion 30 of the separator disk 22 partially supports the stack 14 of sheet material articles 16 as the separator disk 22 is rotated from the position shown in FIG. 1 to the position shown in FIG. 2. The lower side (not shown) of the large radius portion 30 of the separator disk 22 is provided with a cam surface which is engageable with the upper side surface of a lowermost sheet material article in the stack 14 of sheet material articles to deflect the lowermost sheet material article downward toward a rotating feed drum 42. The cam surface on the lower side of the large radius portion 30 of the separator disk 22 may be constructed in the manner disclosed in U.S. Pat. No. 3,650,525 or in U.S. Pat. No. 5,330,169.

A suction applicator head 46 is operable to apply suction to a lower side surface of the lowermost sheet material article 16 in the stack 14 of sheet material articles to grip the lowermost sheet material article. The suction applicator head 46 is moved downward relative to the hopper 12 and separator disk 22. This moves a gripped corner portion 48 of a lowermost sheet material article 16 in the stack of sheet material articles off of a generally horizontal upper side surface 50 on a restrictor member 52. The restrictor member 52 forms part of the hopper 12 and supports the corner portion 48 of the stack 14 of sheet material articles.

As the gripped corner portion 48 of the lowermost sheet material article 16 in the stack 14 of sheet material articles is disengaged from the upper side surface 50 of the restrictor member 52 by downward movement of the suction applicator head 46, a gap is formed between the lowermost sheet material article in the stack 14 of sheet material articles and the next adjacent sheet material article. The leading edge portion 34 on the large radius portion 30 of the separator disk 22 (FIG. 1) then moves into the gap. As the separator disk 22 moves into the gap, the lowermost sheet material article is engaged by the cam surface on the lower side of the separator disk. The cam surface on the lower side of the separator disk 22 applies force against the upper side of the lowermost sheet material article to effect movement of the leading edge portion 64 of the lowermost sheet material article 16 downward toward the feed drum 42.

Figure 2:
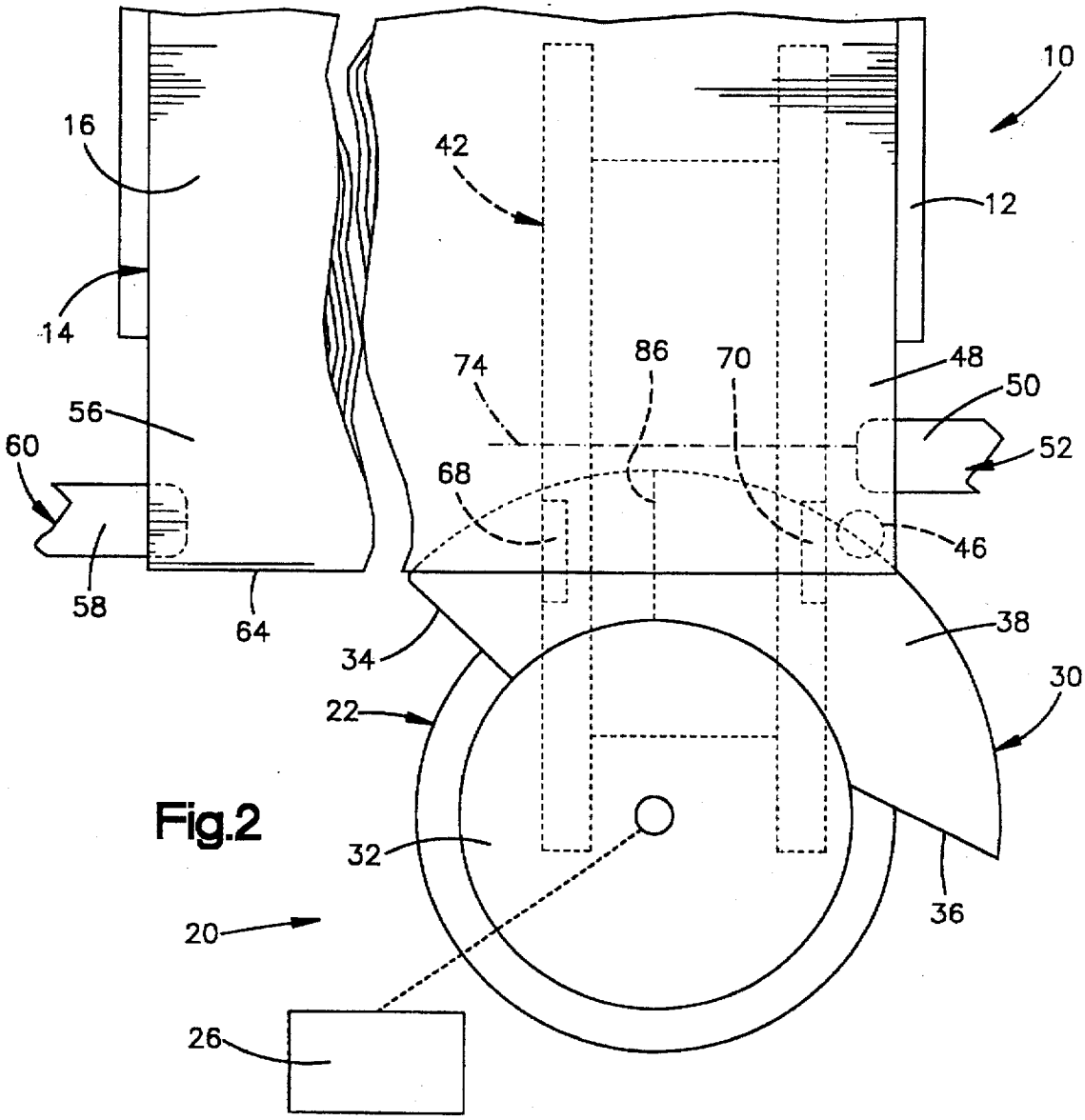
FIG. 2 is a schematic top plan view, generally similar to FIG. 1, illustrating the manner in which the leading edge portion of the separator disk moves out from between the lowermost sheet material article and a next adjacent sheet material article in the stack of sheet material articles.

As the separator disk 22 rotates from the position shown in FIG. 1 to the position shown in FIG. 2, the large radius portion 30 of the separator disk 22 deflects a second corner portion 56 of the lowermost sheet material article 16 in the stack 14 of sheet material articles downward. As this occurs, the corner portion 56 of the lowermost sheet material article is pulled off of or disengaged from a generally horizontal upper side surface 58 of a restrictor member 60.

Thus, the corner portion 48 of the lowermost sheet material article is disengaged from the restrictor member 52 by the suction applicator head 46 and the corner portion 56 of the lowermost sheet material article is disengaged from the restrictor member 60 by the separator disk 22. Once this has occurred, the separator disk 22 will have deflected a leading edge 64 of the lowermost sheet material article 16 downward to a location where it can be readily engaged by grippers 68 and 70 on the rotating feed drum 42. The feed drum 42 rotates about a horizontal axis 74.

The general relationship of the separator disk 22 to the hopper 12, feed drum 42, and suction applicator head 46 is the same as is disclosed in U.S. Pat. No. 3,650,525 and in U.S. Pat. No. 3,702,187. Although the separator assembly 20 is utilized to separate sheet material articles at the bottom of the stack 14 of the sheet material articles, it is contemplated that the separator assembly could be designed to separate sheet material articles at the top of the stack. If this was done, the restrictor members 52 and 60 would engage the top of the stack of sheet material articles. It is also contemplated that the separator assembly 20 could be used with a stack of sheet material articles disposed in an on-edge relationship.

In accordance with one of the features of the present invention, the drive assembly 26 is operable to vary the speed of rotation of the separator disk 22 between a high speed and a low speed during each revolution of the separator disk. The separator disk 22 rotates relatively fast when the large radius portion 30 is disposed between the lowermost sheet material article 16 on the stack 14 of sheet material articles and the next adjacent sheet material article. Similarly, when the large radius portion 30 of the separator disk 22 is spaced from the stack 14 of sheet material articles, the separator disk 22 is rotated at a relatively low speed. By varying the speed of rotation of the separator disk 22, the amount of cycle time required to separate the lowermost sheet material article 16 from the stack 14 and the restrictor members 52 and 60 is decreased. The decrease in cycle time required to separate the lowermost sheet material article 16 from the stack 14 allows longer sheet material articles 16 to be fed from the hopper 12. However, if the same size sheet material article 16 is fed from the hopper 12, a larger gap will exist between the trailing edge of one sheet material article 16 and the leading edge of a next succeeding sheet material article.

During rotation of the separator disk from the position shown in FIG. 1 through the position shown in FIG. 2, the speed of rotation of the separator disk 22 is maximized. This results in the lowermost sheet material article 16 in the stack of sheet material articles being quickly separated from the next adjacent sheet material article and the restrictor 60. Therefore, a relatively short time elapses between the time when the leading edge portion 34 of the separator disk 22 moves between the lowermost sheet material article (FIG. 1) and the time when the leading edge portion 34 of the separator disk 22 moves out from between the sheet material articles (FIG. 2). This tends to minimize the amount of cycle time required to separate a sheet material article 16 from the stack 14 of sheet material articles. This maximizes the amount of cycle time remaining for pulling the sheet material article 16 from the stack 14 of sheet material articles.

After the lowermost sheet material article 16 in the stack 14 of sheet material articles has been separated from the next adjacent sheet material article by the separator disk 22, the speed of rotation of the separator disk decreases. Decreasing the speed of rotation of the separator disk 22 increases the time which elapses between movement of the separator disk from the position shown in FIG. 2 back to the position shown in FIG. 1.

In the illustrated embodiment of the invention, the drive assembly 26 includes a pair of identical noncircular gears 80 and 82 (FIG. 3) which are disposed in meshing engagement. The noncircular gear 80 is fixedly connected with the separator disk 22. The noncircular gear 82 is driven by a main drive assembly (not shown). During operation of the apparatus 10, the main drive assembly rotates a drive shaft 84 connected with the noncircular gear 82 at a constant speed. Due to the noncircular configuration of the gears 80 and 82, the rate of rotation of the noncircular gear 80 and the separator disk 22 are varied even though the rate of rotation of the noncircular gear 82 remains constant.

The illustrated noncircular gears 80 and 82 are elliptical gears. The velocity ratio resulting from meshing engagement of the elliptical gears 80 and 82 varies from a high ratio to a low ratio during rotation of the elliptical gears. If the high velocity ratio of the elliptical gears 80 and 82 is considered as being X, the low velocity ratio of the elliptical gears will be 1/X. For example, the velocity ratio of the elliptical gears 80 and 82 may vary between 10 and 1/10 during each revolution of rotation of the elliptical gears 80 and 82. Of course, the extent of the variation of the velocity ratio between the elliptical gears 80 and 82 will depend upon the specific sizes of the gears.

Figure 3:
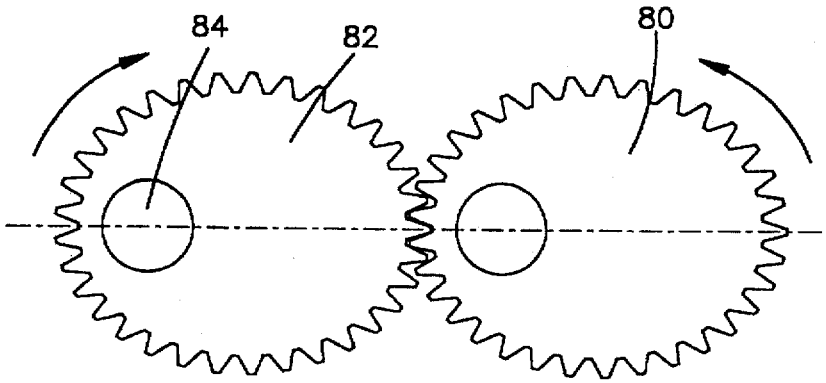
FIG. 3 is a schematic plan view of noncircular gears used in a variable speed drive for the separator disk of FIGS. 1 and 2.

During operation of the apparatus 10, when the elliptical gear 82 is rotated through one complete revolution by the constant speed drive shaft 84, the elliptical gear 80 and separator disk 22 are rotated together through one complete revolution. When the distance between center of the drive shaft 84 and the area of meshing engagement of the elliptical gears 80 and 82 is maximized, as shown in FIG. 3, the elliptical gear 80 and the separator disk 22 are being rotated at a maximum or high speed. As the elliptical gear 80 and separator disk 22 are rotated through one half of a revolution in a counterclockwise direction from the position shown in FIG. 3, their rotational speed is decreased to a minimum or low speed. During continued rotation of the elliptical gear 80 and separator disk 22 through the next one half of a revolution in a counterclockwise direction, their rotational speed is increased to a maximum speed. Therefore, during each revolution of the separator disk 22, the speed of rotation of the separator disk is increased from a low speed to a high speed and is decreased from the high speed back to the low speed.

The speed of rotation of the separator disk 22 is a maximum when the leading edge portion 34 of the separator disk is at the position indicated by the dashed line 86 in FIG. 2. The position indicated by the dashed line 86 in FIG. 2 is approximately half way between the position at which the leading edge portion 34 of the separator disk 22 enters the stack 14 of the sheet material articles 16 and the position at which the leading edge portion of the separator disk has exited from the stack of sheet material articles. Of course, the speed of rotation of the separator disk is a minimum when the leading edge portion 34 of the separator disk is at a position offset by 180° from the position indicated by the dashed line 86 in FIG. 2.

It is contemplated that the precise time at which the grippers 68 and 70 grip the leading edge portion 64 of the lowermost sheet material article 16 may vary depending upon the characteristics of the sheet material articles and the speed of operation of the apparatus 10. However, it is believed that it may be desired to have the grippers 68 and 70 grip the leading edge portion of the lowermost sheet material article 16 as the leading edge portion 34 of the separator disk 22 exits from the stack 14 of sheet material articles. At this time, the upper side surface 38 of the separator disk 22 will be holding up the sheet material article 16 which is next adjacent to the lowermost sheet material article and the lowermost sheet material article will have been disengaged from the restrictor member 60 and fully deflected downward by the cam surface on the bottom of the separator disk 22.

Although it is presently preferred to have the variable speed drive assembly 26 include elliptical gears 80 and 82 to rotate the separator disk 22, it is contemplated that the variable speed drive assembly could have a different construction if desired. Thus, the variable speed drive assembly 26 could use drive mechanisms other than noncircular gears to vary the speed of rotation of the separator disk 22. For example, a linkage arrangement, similar to the linkage arrangement shown in U.S. Pat. No. 5,441,375 could be used if desired. Alternatively, the separator disk 22 could be driven by a variable speed motor or by a combination of a variable speed motor and a variable speed drive mechanism.

One Specific Embodiment

Figure 4:
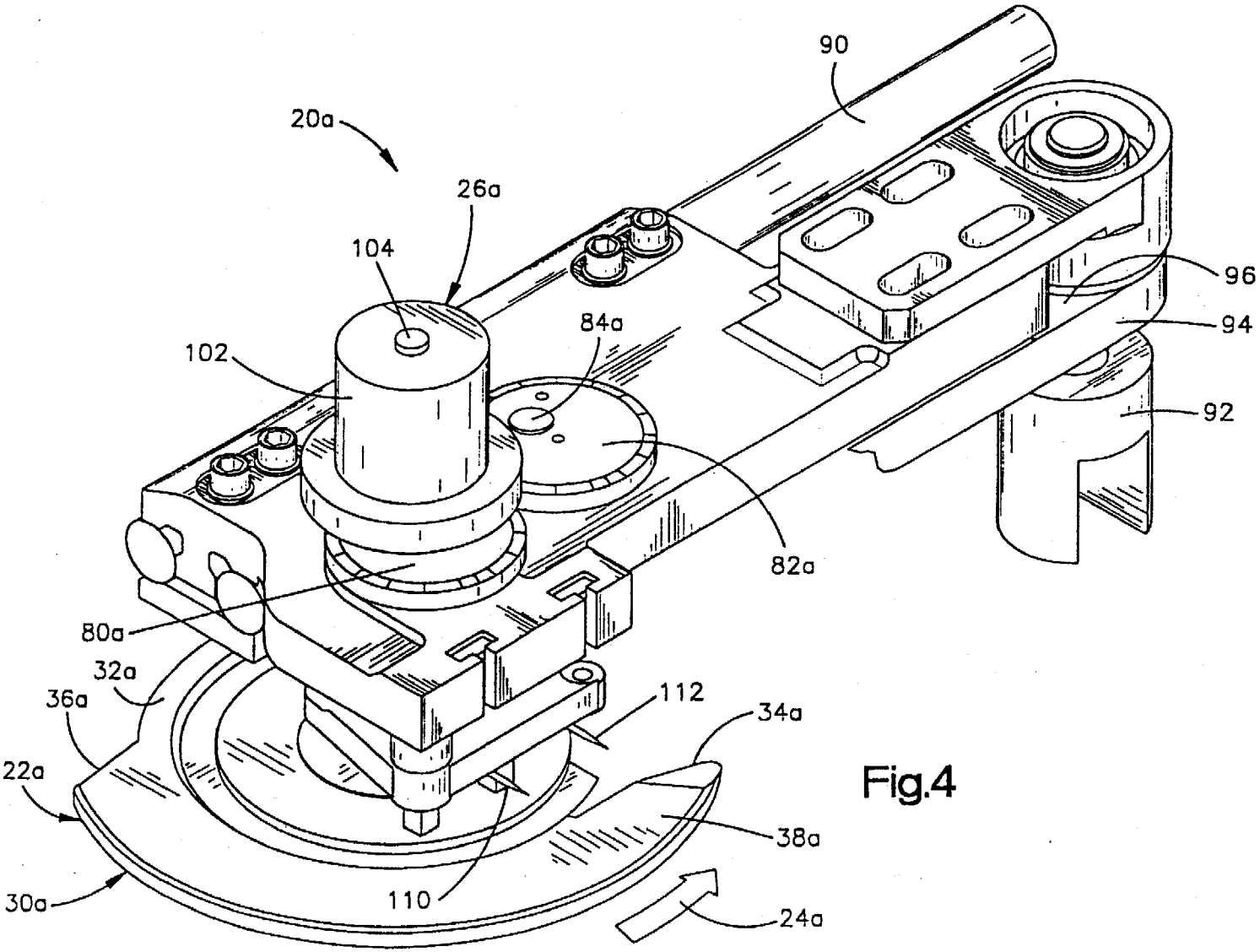
FIG. 4 is a simplified pictorial illustration of one specific embodiment of apparatus constructed in accordance with the present invention.

One specific preferred embodiment of the separator assembly is illustrated in FIG. 4. Since the embodiment of the separator assembly illustrated in FIG. 4 is the same as the embodiment of the separator assembly illustrated schematically in FIGS. 1–3, similar numerals will be utilized to designate similar components, the suffix letter "a" being added to the numerals of FIG. 4 to avoid confusion.

A separator assembly **20*a* includes a separator disk 22*a* which is driven in the direction of an arrow 24*a* by a variable speed drive assembly 26*a*. The separator disk 22*a* includes a large radius portion 30*a* which extends radially outward from a circular base portion 32*a*. The large radius portion 30*a* has a leading edge portion 34*a* and a trailing edge portion 36*a*. The large radius portion 30*a* has a flat upper side surface 38*a***.

The drive assembly **26*a* and separator disk 22*a* are supported on a frame member 90 (FIG. 4). A rotatable input member 92 is continuously rotated at a constant speed during operation of the separator assembly 20*a*. A toothed timing belt 94 transmits force from a toothed sprocket 96 connected with the input member 92. The belt 94 drives a shaft 84*a* fixedly connected with an elliptical gear 82*a* at a constant speed. The elliptical gear 82*a* is disposed in meshing engagement with an elliptical gear 80*a***.

A single position clutch assembly 102 connects the driven elliptical gear **80*a* with a vertical drive shaft 104 for the separator disk 22*a*. The single position clutch assembly 102 is disengageable to enable the input member 92 to be rotated without rotating the separator disk 22*a*. The single position clutch assembly 102 is engageable only when the elliptical gears 80*a* and 82*a* are in a predetermined spatial relationship with the leading and trailing edge portions 34*a* and 36*a* of the separator disk 22*a***.

A pair of needles 110 and 112 are horizontally reciprocatable to engage the leading edge portion 64 (FIG. 1) of sheet material article 16 in the stack 14 of sheet material articles. The manner in which the needles 110 and 112 are reciprocated is the same as is disclosed in the aforementioned U.S. Pat. No. 3,702,187.

Operation

When sheet material articles are to be fed, the stack 14 of sheet material articles 16 is positioned in the hopper 12 (FIG. 1). The stack 14 of sheet material articles is supported by a bottom wall (not shown) of the hopper 12 and by the restrictor members 52 and 60. It should be understood that restrictor members having many different configurations could be used to partially support the leading edge portion 64 of the stack of sheet material articles in the hopper 12.

When a sheet feed cycle is to be initiated, the suction applicator head 46 is moved upward by a suitable cam and linkage arrangement (not shown) to engage the lower side surface of the lowermost sheet material article 16 in the stack 14 of sheet material articles. The suction applicator head 46 is then moved downward to pull the corner portion 48 of the lowermost sheet material article off of the upper side surface 50 of the restrictor member 52. As this occurs, a gap is formed between the lowermost sheet material article 16 and the next adjacent sheet material article.

Immediately after formation of the gap between the upper side of the lowermost sheet material article 16 and the lower side of the next adjacent sheet material article, the leading edge portion 34 of the separator disk 22 moves into the gap. As this occurs, the flat upper side surface 38 on the large radius portion 30 of the separator disk 22 moves into supporting engagement with the lower side of the sheet material article which is next adjacent to the lowermost sheet material article.

As the separator disk 22 continues to rotate, the cam on the lower side of the large radius portion 30 of the separator disk applies a downward force against the upper side surface of the lowermost sheet material article 16. The force applied against the lowermost sheet material article 16 by the separator disk 22 moves a leading portion of the lowermost sheet material article 16 away from the next adjacent sheet material article. As this occurs, the corner portion 56 of the lowermost sheet material article is disengaged from the upper side surface 58 of the restrictor member 60.

The leading edge portion 64 of the lowermost sheet material article 16 is then fully deflected downward to a location where it can be engaged by the grippers 68 and 70 on the continuously rotating feed drum 42. Once the grippers 68 and 70 on the feed drum 42 have gripped the leading edge portion 64 of the lowermost sheet material article, continued rotation of the feed drum moves the grippers 68 and 70 away from the hopper 12 to pull the lowermost sheet material article from the hopper. The grippers 68 and 70 begin to grip the leading edge portion 64 of the lowermost sheet material article 16 as the leading edge portion 34 of the separator disk 22 leaves the stack 14 of the sheet material articles 16 (FIG. 2). Of course, the grippers 68 and 70 could begin to grip the leading edge portion 64 of the lowermost sheet material article 16 either shortly before or shortly after the leading edge portion 34 of the separator disk 22 leaves the stack 14 of sheet material articles 16.

In order to minimize the cycle time required to separate the lowermost sheet material article 16 from the stack 14 of sheet material articles, the speed of rotation of the separator disk 22 is maximized during the time in which the leading edge portion 34 of the separator disk initially enters the gap between the lowermost sheet material article and the next adjacent sheet material article and the time when the lowermost sheet material article is fully deflected into position for engagement by the grippers 68 and 70. Thus, during the time in which the separator disk 22 moves from the position shown in FIG. 1 to the position shown in FIG. 2 the speed of rotation of the separator disk is maximized. The maximum speed of rotation of the separator disk 22 occurs when the leading edge portion 34 of the separator disk is approximately at the position indicated by the dashed line 86 in FIG. 2.

As the separator disk 22 continues to rotate from the position shown in FIG. 2, the speed of rotation of the separator disk is decreased until a minimum velocity is reached. The minimum velocity of the separator disk 22 is the reciprocal of the maximum velocity. Thus, if the maximum velocity of the separator disk 22 is X, the minimum velocity of the separator disk is 1/X. The speed of rotation of the separator disk 22 is a minimum when the leading edge portion 34 of the separator disk is at a position offset by 180° from the dashed line 86 in FIG. 2.

As the leading edge portion 34 of the separator disk 22 approaches the position shown in FIG. 1, the speed of rotation of the separator disk is increasing. Immediately before the leading edge portion 34 of the separator disk 22 enters the gap between the lowermost sheet material article 16 in the stack 14 of sheet material articles and the next adjacent sheet material article, the separator disk will have been accelerated to almost its maximum velocity. As the leading edge portion 34 of the separator disk moves from a location offset from the stack 14 of sheet material articles to a location in which the leading edge portion 34 of the separator disk is half way between the position shown in FIG. 1 and the position shown in FIG. 2, the speed of rotation of the separator disk will continue to increase at a relatively slow rate. As the leading edge portion 34 of the separator disk 22 moves from the maximum velocity position indicated by the dashed line 86 in FIG. 2 to the position shown in solid lines in FIG. 2, the velocity of the separator disk will decrease at a relatively slow rate.

As the velocity of the separator disk 22 continues to decrease, the lowermost sheet material article is pulled from the hopper 12. The operating cycle of the apparatus 10 is then repeated for each successive sheet material article 16 in the stack 14 of sheet material articles. Although the sheet material articles 16 are fed from the bottom of the stack 14 of sheet material articles by the apparatus 20, it is contemplated that an apparatus similar to the apparatus 20 could be used to feed sheet material articles from the top of a stack of sheet material articles.

Conclusion

In view of the foregoing description, it is apparent that the present invention provides a new and improved method and apparatus 10 for use in handling sheet material articles 16. The apparatus 10 includes a separator assembly 20 which separates one sheet material article 16 in a stack 14 of sheet material articles from a next adjacent sheet material article in the stack of sheet material articles. Thereafter, a feed drum 42 moves the one sheet material article from the stack of sheet material articles.

The separator assembly 20 includes a rotatable separator disk 22. A variable speed drive 26 is connected with the separator disk 22 and varies the speed of rotation of the separator disk between a high speed and a low speed during each revolution of the separator disk relative to the stack 14 of sheet material articles 16.

When one sheet material article 16 is to be fed from the stack 14 of sheet material articles, a gap may be formed between a portion of the one sheet material article in the stack of sheet material article. The leading edge 34 of the rotating separator disk 22 is moved from a location offset to one side of the stack 14 of sheet material articles 16 to a location between the one sheet material article and the next adjacent sheet material article. As this occurs, the speed of rotation of the separator disk 22 is increased.

The stack 14 of sheet material articles 16 may advantageously be engaged by first and second restrictor members 52 and 60 disposed in engagement with opposite sides of the stack 14 of sheet material articles 16. One sheet material article 16 in the stack 14 of sheet material articles is moved relative to the restrictor member 52 to form a gap into which the leading edge portion 34 of the rotating separator disk 22 moves. During continued rotation of the separator disk 22, the one sheet material article 16 is disengaged from the restrictor member 60 under the influence of force applied against the one sheet material article by the separator disk.

Having described the invention, the following is claimed:

1. An apparatus for use in handling sheet material articles, said apparatus comprising hopper means for supporting a stack of sheet material articles, separator means for sequentially separating edge portions of sheet material articles from adjacent sheet material articles in the stack of sheet material articles, and feed means for sequentially feeding sheet material articles in the stack of sheet material articles from said hopper means, said separator means including a rotatable separator disk which is movable between a side surface of one sheet material article in the stack of sheet material articles and a side surface of a next adjacent sheet of material article in the stack of sheet material articles while at least a portion of the side surface of the one sheet material article is disposed in engagement with at least a portion of the side surface of the next adjacent sheet material article, and variable speed drive means connected with said separator disk for rotating said separator disk in one direction through a plurality of revolutions relative to the stack of sheet material articles and for varying the speed of rotation of said separator disk between a high speed and a low speed during each of the revolutions of the separator disk relative to the stack of sheet material articles.

2. An apparatus as set forth in claim 1 wherein said variable speed drive means is operable to decrease the speed of rotation of the separator disk from the high speed to the low speed and to increase the speed of rotation of the separator disk from the low speed to the high speed during each revolution of the plurality of revolutions of the separator disk in the one direction relative to the stack of sheet material articles.

3. An apparatus as set forth in claim 2 wherein said feed means is operable to sequentially feed sheet material articles during at least a portion of the time in which the speed of rotation of said separator disk is being decreased from the high speed to the low speed and during at least a portion of the time in which the speed of rotation of said separator disk is being increased from the low speed to the high speed during each revolution of the separator disk in the one direction.

4. An apparatus as set forth in claim 1 wherein said hopper means includes a first restrictor having a side surface for engaging the one sheet material article in the stack of sheet material articles at a location adjacent to a first side of the stack of sheet material articles and a second restrictor having an upper side surface for engaging the one sheet material article in the stack of sheet material articles at a location adjacent to a second side of the stack of sheet material articles, said separator disk having surface means for applying force against the side surface of the one sheet material article in the stack of sheet material articles to disengage the one sheet material article in the stack of sheet material articles from the side surface of at least one of said first and second restrictors.

5. An apparatus as set forth in claim 1 wherein said separator disk has a first portion with a relatively large radius, a second portion with a relatively small radius, and an edge portion which extends between said first and second portions of said separator disk, said variable speed drive means being operable to rotate said separator disk in one direction with said edge portion leading said first portion of said separator disk to move said edge portion of said separator disk between the one sheet material article and the next adjacent sheet material article, said drive means being operable to increase the speed of rotation of said separator disk after said edge portion of said separator disk moves between the one sheet material article and the next adjacent sheet material article.

6. An apparatus as set forth in claim 5 wherein said variable speed drive means is operable to rotate said separator disk in the one direction to move said edge portion of said separator disk out from between the one sheet material article and the next adjacent sheet material article, said drive means being operable to decrease the speed of rotation of said separator disk after said edge portion of said separator disk moves out from between the one sheet material article and the next adjacent sheet material article.

7. A method of sequentially feeding sheet material articles from a bottom of a stack of sheet material articles, said method comprising the steps of moving a portion of a rotating separator disk between a lowermost sheet material article and a next adjacent sheet material article in the stack of sheet material articles to deflect an edge portion of the lowermost sheet material article downward, changing the speed of rotation of the rotating separator disk between a high speed and a low speed during each revolution of the rotating separator disk, gripping the downwardly deflected edge portion of the lowermost sheet material article in the stack of sheet material articles with a gripper, and moving the gripper away from the stack of sheet material articles to pull the sheet material article gripped by the gripper from the stack of sheet material articles.

8. A method as set forth in claim 7 wherein said step of moving a portion of the rotating separator disk between the lowermost sheet material article and the next adjacent sheet material article includes moving a leading edge portion of the rotating separator disk from a location offset to one side of the stack of sheet material articles to a location in which the leading edge portion of the rotating separator disk is disposed between the lowermost sheet material article and the next adjacent sheet material article in the stack of sheet material articles, said step of changing the speed of rotation of the rotating separator disk includes increasing the speed of rotation of the rotating separator disk as the leading edge portion of the rotating separator disk is moved from the position offset to one side of the stack of sheet material articles to the location in which the leading edge portion of the rotating separator disk is disposed between the lowermost sheet material article and the next adjacent sheet material article in the stack of sheet material articles.

9. An apparatus for use in handling sheet material articles, said apparatus comprising hopper means for supporting a stack of sheet material articles, separator means for sequentially separating edge portions of sheet material articles from adjacent sheet material articles in the stack of sheet material articles, and feed means for sequentially feeding sheet material articles in the stack of sheet material articles from said hopper means, said separator means including a rotatable separator disk which is movable between a side surface of one sheet material article in the stack of sheet material articles and a side surface of a next adjacent sheet of material article in the stack of sheet material articles while at least a portion of the side surface of the one sheet material article is disposed in engagement with at least a portion of the side surface of the next adjacent sheet material article, and variable speed drive means connected with said separator disk for rotating said separator disk through a plurality of revolutions relative to the stack of sheet material articles and for varying the speed of rotation of said separator disk between a high speed and a low speed during each of the revolutions of the separator disk relative to the stack of sheet material articles, said variable speed drive means includes a plurality of noncircular gears.

10. An apparatus for use in handling sheet material articles, said apparatus comprising hopper means for supporting a stack of sheet material articles, separator means for sequentially separating edge portions of sheet material articles from adjacent sheet material articles in the stack of sheet material articles, and feed means for sequentially feeding sheet material articles in the stack of sheet material articles from said hopper means, said separator means including a rotatable separator disk which is movable between a side surface of one sheet material article in the stack of sheet material articles and a side surface of a next adjacent sheet of material article in the stack of sheet material articles while at least a portion of the side surface of the one sheet material article is disposed in engagement with at least a portion of the side surface of the next adjacent sheet material article, and variable speed drive means connected with said separator disk for rotating said separator disk through a plurality of revolutions relative to the stack of sheet material articles and for varying the speed of rotation of said separator disk between a high speed and a low speed during each of the revolutions of the separator disk relative to the stack of sheet material articles, said variable speed drive means is operable to rotate said separator disk at a maximum speed of X and a minimum speed of 1/X during rotation of said separator disk.

11. An apparatus for use in handling sheet material articles, said apparatus comprising hopper means for supporting a stack of sheet material articles, separator means for sequentially separating edge portions of sheet material articles from adjacent sheet material articles in the stack of sheet material articles, and feed means for sequentially feeding sheet material articles in the stack of sheet material articles from said hopper means, said separator means including a rotatable separator disk which is movable between a side surface of one sheet material article in the stack of sheet material articles and a side surface of a next adjacent sheet of material article in the stack of sheet material articles while at least a portion of the side surface of the one sheet material article is disposed in engagement with at least a portion of the side surface of the next adjacent sheet material article, said separator means further includes a suction applicator head for applying suction to a portion of the one sheet material article in the stack of sheet material articles prior to movement of said rotatable separator disk between the side surface of the one sheet material article and the side surface of the next adjacent sheet material article, and variable speed drive means connected with said separator disk for rotating said separator disk through a plurality of revolutions relative to the stack of sheet material articles and for varying the speed of rotation of said separator disk between a high speed and a low speed during each of the revolutions of the separator disk relative to the stack of sheet material articles.

12. An apparatus as set forth in claim 11 wherein said variable speed drive means is operable to decrease the speed of rotation of the separator disk from the high speed to the low speed and to increase the speed of rotation of the separator disk from the low speed to the high speed during each revolution of the plurality of revolutions of the separator disk relative to the stack of sheet material articles.

13. An apparatus as set forth in claim 12 wherein said feed means is operable to sequentially feed sheet material articles during at least a portion of the time in which the speed of rotation of said separator disk is being decreased from the high speed to the low speed and during at least a portion of the time in which the speed of rotation of said separator disk is being increased from the low speed to the high speed during each revolution of the separator disk.

14. An apparatus as set forth in claim 11 wherein said hopper means includes a first restrictor having a side surface for engaging the one sheet material article in the stack of sheet material articles at a location adjacent to a first side of the stack of sheet material articles and a second restrictor having an upper side surface for engaging the one sheet material article in the stack of sheet material articles at a location adjacent to a second side of the stack of sheet material articles, said separator disk having surface means for applying force against the side surface of the one sheet material article in the stack of sheet material articles to disengage the one sheet material article in the stack of sheet material articles from the side surface of at least one of said first and second restrictors.

15. An apparatus as set forth in claim 11 wherein said variable speed drive means includes a plurality of noncircular gears.

16. An apparatus as set forth in claim 11 wherein said variable speed drive means is operable to rotate said separator disk at a maximum speed of X and a minimum speed of 1/X during rotation of said separator disk.

17. An apparatus as set forth in claim 11 wherein said separator disk has a first portion with a relatively large radius, a second portion with a relatively small radius, and an edge portion which extends between said first and second portions of said separator disk, said variable speed drive means being operable to rotate said separator disk with said edge portion leading said first portion of said separator disk to move said edge portion of said separator disk between the one sheet material article and the next adjacent sheet material article, said drive means being operable to increase the speed of rotation of said separator disk after said edge portion of said separator disk moves between the one sheet material article and the next adjacent sheet material article.

18. An apparatus as set forth in claim 17 wherein said variable speed drive means is operable to rotate said separator disk to move said edge portion of said separator disk out from between the one sheet material article and the next adjacent sheet material article, said drive means being operable to decrease the speed of rotation of said separator disk after said edge portion of said separator disk moves out from between the one sheet material article and the next adjacent sheet material article.

19. A method for use in handling sheet material articles, said method comprising the steps of forming a gap between a portion of one sheet material article and a next adjacent sheet material article in a stack of sheet material articles, moving a portion of a rotating separator disk into the gap between a portion of the one sheet material article and the next adjacent sheet material article in the stack of sheet material articles, and increasing the speed of rotation of the separator disk while performing said step of moving a portion of a rotating separator disk into the gap between a portion of the one sheet material article and the next adjacent sheet material article in the stack of sheet material articles, said step of increasing the speed of rotation of the separator disk includes increasing the speed of rotation of the separator disk to a speed of X, said method further including the step of subsequently decreasing the speed of rotation of the separator disk to a speed of 1/X.

20. A method as set forth in claim 19 wherein said the step of decreasing the speed of rotation of the separator disk is performed after performing said step of moving a portion of the rotating separator disk into the gap between a portion of the one sheet material article and the next adjacent sheet material article in the stack of sheet material articles.

21. A method as set forth in claim 19 further including the step of engaging a first portion of a first side surface of the one sheet material article in the stack of sheet material articles with a first restrictor member and engaging a second portion of the first side surface of the one sheet material article with a second restrictor member, said step of forming a gap between a portion of the one sheet material article and the next adjacent sheet material article in the stack of sheet material articles includes disengaging the first portion of the first side surface of the one sheet material article from the first restrictor member, said step of moving a portion of the rotating separator disk into the gap between a portion of the one sheet material article and the next adjacent sheet material article in the stack of sheet material articles includes applying force against a second side surface of the one sheet material article with the rotating separator disk and disengaging the second portion of the first side surface of the one sheet material article from the second restrictor member under the influence of force applied against the one sheet material article by the rotating separator disk.

22. A method as set forth in claim 19 wherein said step of moving a portion of a rotating separator disk into the gap between one sheet material article and a next adjacent sheet material article includes moving a leading edge portion of the rotating separator disk between the one sheet material article and the sheet material article which is next adjacent to the one sheet material article, said method further including moving the leading edge portion of the rotating separator disk out from between the one sheet material article and the sheet material article which is next adjacent to the one sheet material article, said step of decreasing the speed of rotation of the separator disk being performed after having performed said step of moving the leading edge portion of the rotating separator disk out from between the one sheet material article and the sheet material article which is next adjacent to the one sheet material article.

23. A method as set forth in claim 19 wherein said step of moving a portion of a rotating separator disk into the gap includes moving an edge portion of the separator disk from a location in which the edge portion of the separator disk is offset to one side of the stack of sheet material articles to a location in which the edge portion of the separator disk is disposed in the gap between the one sheet material article and the next adjacent sheet material article.

24. A method for use in handling sheet material articles, said method comprising the steps of forming a gap between a portion of one sheet material article and a next adjacent sheet material article in a stack of sheet material articles, rotating a separator disk in a first direction about an axis extending through a base portion of the separator disk, moving a portion of the rotating separator disk into the gap between a portion of the one sheet material article and the next adjacent sheet material article in the stack of sheet material articles while continuing to rotate the separator disk in the first direction about the axis extending through the base portion of the separator disk, and, thereafter, increasing the speed of rotation of the separator disk in the first direction about the axis extending through the base portion of the separator disk while a portion of the rotating separator disk is disposed in the gap between a portion of the one sheet material article and the next adjacent sheet material article in the stack of sheet material articles.

25. A method as set forth in claim 24 further including the step of decreasing the speed of rotation of the separator disk in the first direction about the axis extending through the base portion of the separator disk after performing said step of moving a portion of the rotating separator disk into the gap between a portion of the one sheet material article and the next adjacent sheet material article in the stack of sheet material articles.

26. A method as set forth in claim 24 further including the step of engaging a first portion of a first side surface of the one sheet material article in the stack of sheet material articles with a first restrictor member and engaging a second portion of the first side surface of the one sheet material article with a second restrictor member, said step of forming a gap between a portion of the one sheet material article and the next adjacent sheet material article in the stack of sheet material articles includes disengaging the first portion of the first side surface of the one sheet material article from the first restrictor member while maintaining the second portion of the first side surface of the one sheet material article in engagement with the second restrictor member, said step of moving a portion of the rotating separator disk into the gap between a portion of the one sheet material article and the next adjacent sheet material article in the stack of sheet material articles includes applying force against a second side surface of the one sheet material article while increasing the speed of rotation of the separator disk in the first direction and disengaging the second portion of the first side surface of the one sheet material article from the second restrictor member under the influence of force applied against the one sheet material article while continuing to rotate the separator disk in the first direction.

27. A method as set forth in claim 24 wherein said step of moving a portion of the rotating separator disk into the gap between one sheet material article and a next adjacent sheet material article includes moving a leading edge portion of the rotating separator disk between the one sheet material article and the sheet material article which is next adjacent to the one sheet material article, said method further including moving the leading edge portion of the rotating separator disk out from between the one sheet material article and the sheet material article which is next adjacent to the one sheet material article, said step of moving the leading edge portion of the rotating separator disk out from between the one sheet material article and the sheet material article which is next adjacent to the one sheet material article is performed while continuing to rotate the separator disk in the first direction about an axis extending through the base portion of the separator disk, and decreasing the speed of rotation of the separator disk in the first direction about an axis extending through the base portion of the separator disk after having performed said step of moving the leading edge portion of the rotating separator disk out from between the one sheet material article and the sheet material article which is next adjacent to the one sheet material article.

28. A method as set forth in claim 24 wherein said step of increasing the speed of rotation of the separator disk includes increasing the speed of rotation of the separator disk to a speed of X in the first direction about the axis extending through the base portion of the separator disk, said method further including the step of subsequently decreasing the speed of rotation of the separator disk to a speed of 1/X while continuing to rotate the separator disk in the first direction about the axis extending through the base portion of the separator disk.

29. A method as set forth in claim 24 wherein said step of moving a portion of a rotating separator disk into the gap includes moving an edge portion of the separator disk from a location in which the edge portion of the separator disk is offset to one side of the stack of sheet material articles to a location in which the edge portion of the separator disk is disposed in the gap between the one sheet material article and the next adjacent sheet material article.

30. A method as set forth in claim 24 further including the step of engaging a first portion of a first side surface of the one sheet material article in the stack of sheet material articles with a first restrictor member and engaging a second portion of the first side surface of the one sheet material article with a second restrictor member, said step of forming a gap between a portion of the one sheet material article and the next adjacent sheet material article in the stack of sheet material articles includes disengaging the first portion of the first side surface of the one sheet material article from the first restrictor member, said step of moving a portion of the rotating separator disk into the gap between a portion of the one sheet material article and the next adjacent sheet material article in the stack of sheet material articles includes applying force against a second side surface of the one sheet material article with the rotating separator disk and disengaging the second portion of the first side surface of the one sheet material article from the second restrictor member under the influence of force applied against the one sheet material article by the rotating separator disk.

31. A method for use in handling sheet material articles, said method comprising the steps of rotating a separator disk through a plurality of revolutions in a first direction, said step of rotating a separator disk includes increasing the speed of rotation of the separator disk in the first direction from a low speed to a high speed and decreasing the speed of rotation of the separator disk in the first direction from the high speed to the low speed during each revolution of the plurality of revolutions of the separator disk in the first direction, and moving a portion of the rotating separator disk between a portion of one sheet material article in a stack of sheet material articles and a next adjacent sheet material article in the stack of sheet material articles, said separator disk being rotated at the high speed in the first direction when the portion of the separator disk is between a portion of the one sheet material article and the next adjacent sheet material article.

32. A method as set forth in claim 31 further including the step of gripping an edge portion of the one sheet material article with a gripper when the portion of the separator disk is between the portion of the one sheet material article and the next adjacent sheet material article, and moving the gripper away from the stack of sheet material articles while decreasing the speed of rotation of the separator disk in the first direction.

33. A method as set forth in claim 31 wherein the stack of sheet material articles is at least partially located by engaging a first portion of the one sheet material article with a first restrictor member and engaging a second portion of the one sheet material article with a second restrictor member, disengaging the first portion of the one sheet material article from the first restrictor member to form a gap between the one sheet material article and the next adjacent sheet material article, said step of moving a portion of the rotating separator disk between a portion of the one sheet material article and the next adjacent sheet material article includes moving the separator disk in the gap between the one sheet material article and the next adjacent sheet material article while rotating the separator disk in the first direction, and, thereafter, disengaging the second portion of the one sheet material article from the second restrictor member under the influence of force applied against the one sheet material article by the separator disk while rotating the separator disk in the first direction.

34. A method as set forth in claim 31 wherein the separator disk has an edge portion which extends between a first portion of the separator disk having a relatively large radius and a second portion having a relatively small radius, said method further including moving the edge portion of the separator disk from a location offset to one side of the stack of sheet material articles to a location between the one sheet material article and the next adjacent sheet material article while increasing the speed of rotation of the separator disk in the first direction.

35. A method as set forth in claim 34 further including moving the edge portion of the separator disk from a location between the one sheet material article and the next adjacent sheet material article to a location offset to the one side of the stack of sheet material articles while decreasing the speed of rotation of the separator disk in the first direction.

* * * * *